US006315305B1

(12) United States Patent
Gien

(10) Patent No.: US 6,315,305 B1
(45) Date of Patent: Nov. 13, 2001

(54) SNOWBOARD BINDING HAVING ADJUSTABLE TOE

(76) Inventor: Yu Tze Gien, 7F, No. 46, Pin Ho 10 Street, Chang Hua (TW), 500

( * ) Notice: Subject to any disclaimer, the term of this patent is extended or adjusted under 35 U.S.C. 154(b) by 0 days.

(21) Appl. No.: 09/513,247

(22) Filed: Feb. 23, 2000

(51) Int. Cl.[7] ..... A63C 9/18

(52) U.S. Cl. ..... 280/14.24; 280/14.21; 280/14.22; 280/11.26; 280/618; 280/617

(58) Field of Search ..... 280/14.24, 14.22, 280/14.21, 618, 11.26, 607, 11.16, 636, 633; 36/97, 7.5, 7.6

(56) References Cited

U.S. PATENT DOCUMENTS

| | | | | |
|---|---|---|---|---|
| 4,083,128 | * | 4/1978 | Rossman | 36/97 |
| 4,836,571 | * | 6/1989 | Corbisiero | 280/600 |
| 5,317,822 | * | 6/1994 | Johnson | 36/101 |
| 5,356,170 | * | 10/1994 | Carpenter et al. | 280/618 |
| 5,480,175 | * | 1/1996 | Astier et al. | 280/607 |
| 5,505,478 | * | 4/1996 | Napoliello | 280/618 |
| 5,967,542 | | 10/1999 | Williams et al. | 280/618 |
| 5,971,407 | * | 10/1999 | Zemke et al. | 280/14.2 |
| 6,024,375 | * | 2/2000 | Johnson | 280/601 |
| 6,062,586 | * | 5/2000 | Korman | 280/613 |
| 6,065,228 | * | 5/2000 | Begey et al. | 36/15 |
| 6,099,018 | * | 8/2000 | Maravetz et al. | 280/624 |
| 6,116,634 | * | 9/2000 | Mometti | 280/613 |
| 6,116,635 | * | 9/2000 | Rigal | 280/618 |
| 6,126,179 | * | 10/2000 | Dodge | 280/14.2 |
| 6,217,039 | * | 4/2001 | Iverson et al. | 280/11.26 |

* cited by examiner

*Primary Examiner*—Lanna Mai
*Assistant Examiner*—Paul Royal, Jr.

(57) ABSTRACT

A snowboard binding includes a binding base having two side walls and having one or more front channels. A toe strap and an instep strap and a heel member are secured to the binding base. A toe member has one or more bottom ribs slidably engaging with the channels of the binding base for guiding the toe member to move relative to the binding base. The toe member has two side panels slidably engaged with the walls and adjustably secured to the toe member for adjusting the snowboard binding to different lengths and for attaching the boots of various sizes to the snowboard with the adjustable snowboard binding.

1 Claim, 4 Drawing Sheets

SNOWBOARD BINDING HAVING ADJUSTABLE TOE

BACKGROUND OF THE INVENTION

1. Field of the Invention

The present invention relates to a snowboard binding, and more particularly to a snowboard binding having an adjustable toe.

2. Description of the Prior Art

U.S. Pat. No. 5,967,542 to Williams et al. discloses a typical snowboard binding adjustable relative to the snowboards. But, the binding base includes a solid structure that may not be adjusted to different lengths for attaching the boots of various sizes, such that the snowboard bindings may be used for attaching a boot of a predetermined size.

The present invention has arisen to mitigate and/or obviate the afore-described disadvantages of the conventional snowboard bindings.

SUMMARY OF THE INVENTION

The primary objective of the present invention is to provide a snowboard binding having an adjustable toe member for adjusting snowboard binding to different lengths and for attaching the boots of various sizes to the snowboard with the adjustable snowboard binding.

In accordance with one aspect of the invention, there is provided a snowboard binding comprising a binding base including two side portions each having a wall extended upward therefrom, and including a front portion having at least one channel formed therein, the walls each including a front portion, a toe strap and an instep strap and a heel member attached to the binding base, a toe member including a bottom portion having at least one rib extended therefrom and slidably engaging with the channel of the binding base for guiding the toe member to move relative to the binding base, the toe member including two sides each having a panel extended therefrom and slidably engaged with the front portion of the walls, and means for adjustably securing the panels of the toe member to the walls.

The front portions of the walls each includes a recess formed therein for defining a shoulder therein and for engaging with the panels of the toe member to limit a relative movement between the toe member and the binding base.

In accordance with the other aspect of the invention, there is provided a snowboard binding comprising a binding base including two side portions each having a wall extended upward therefrom, and including a front portion having at least one channel formed therein, the walls each including a front portion, a toe strap and an instep strap and a heel member attached to the binding base, a toe member including a bottom portion having at least one rib extended therefrom and slidably engaging with the channel of the binding base for guiding the toe member to move relative to the binding base the bottom portion of the toe member including at least one nut provided therein, the front portion of the binding base including at least one hole formed therein, and at least one fastener engaged through the hole of the binding base and engaged with the nut of the toe member for securing the toe member to the binding base.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
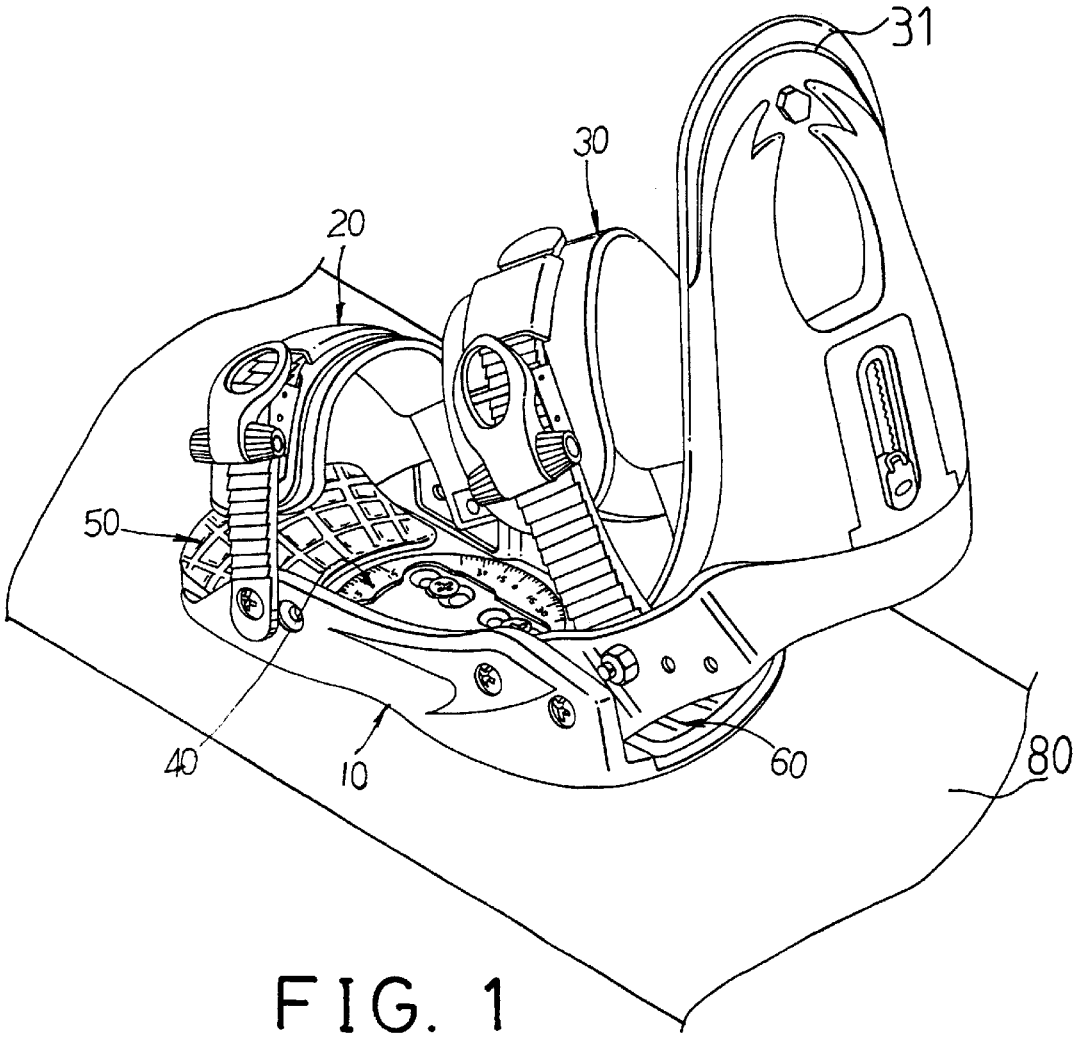
FIG. 1 is a perspective view of a snowboard binding in accordance with the present invention.

Referring to the drawings, and initially to FIG. 1, a snowboard binding in accordance with the present invention comprises a binding base 10 attachable to the snowboard 80 with fasteners or with a mounting plate or disc 40, a toe strap 20 attached to the front portion of the binding base 10, an instep strap 30 and a heel support 31 attached to the rear portion of the binding base 10. The binding base 10 includes a heel member 60 solidly or adjustably secured to the rear port ion thereof, in which the attachment of the heel member 60 to the binding base 10 is not related to the present invention and will not be described in further details. The present invention is to provide a toe member 50 adjustably secured to the front portion of the binding base 10 for adjusting the toe member 50 relative to the binding base 10 and for adjusting the snowboard binding to different lengths and for attaching the boots of various sizes to the snowboard with the snowboard binding.

Figure 3:
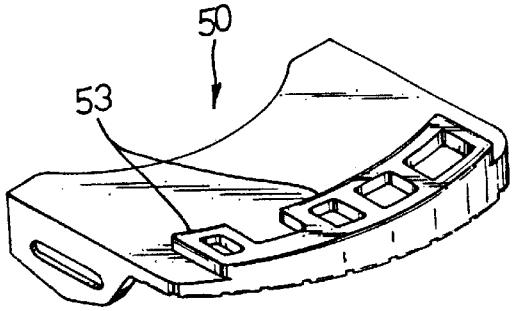
FIG. 3 is a bottom perspective view of the toe member of the snowboard binding.
Figure 2:
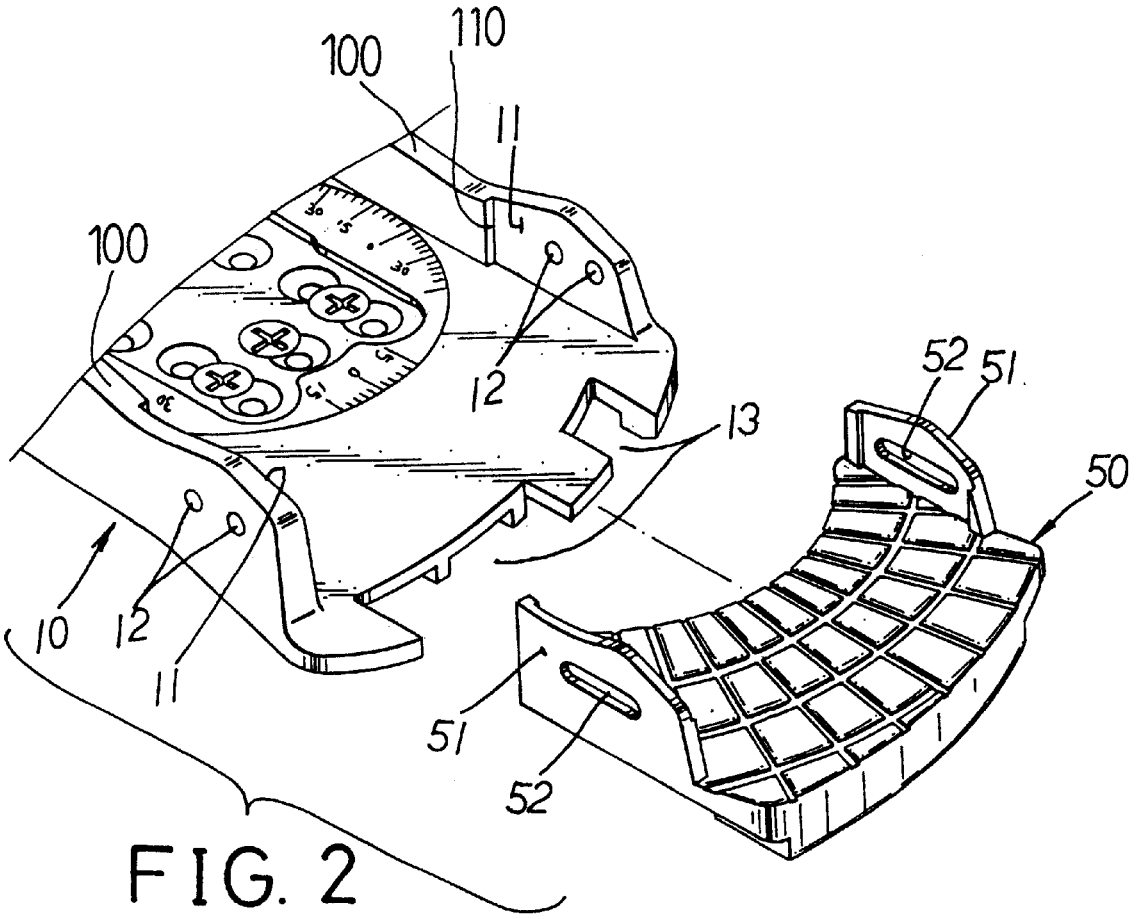
FIG. 2 is a partial exploded view illustrating the toe member for the binding base of the snowboard binding.
Figure 4:
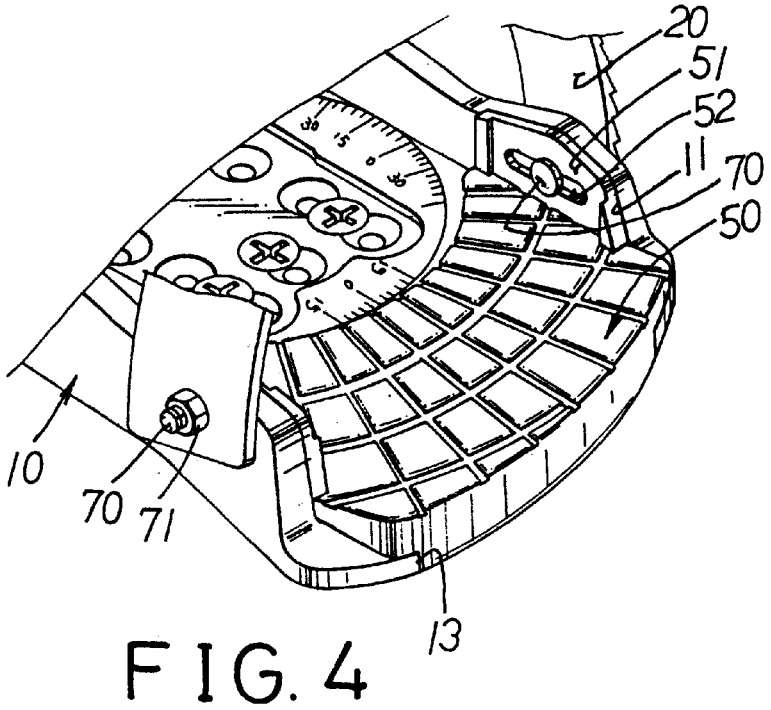
FIG. 4 is a partial upper perspective view showing the toe member that may be adjustably attached to the front portion of the binding base of the snowboard binding.
Figure 7:
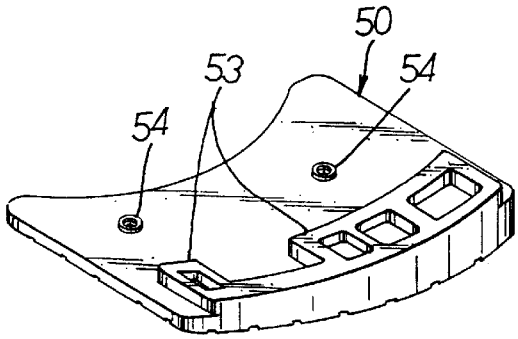
FIG. 7 is a bottom perspective view of the toe member of the snowboard binding as shown in FIG. 6.
Figure 5:
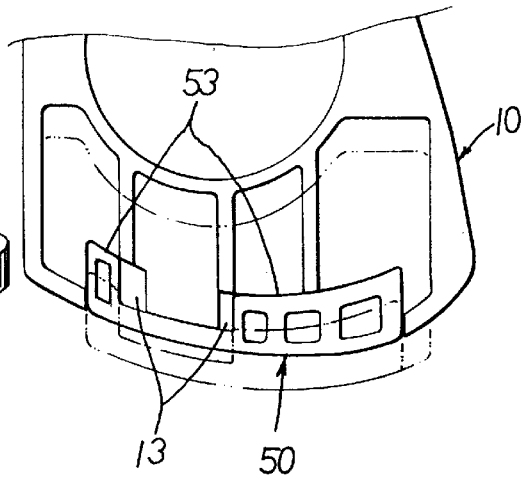
FIG. 5 is a partial bottom plane view illustrating the adjustment of the toe member relative to the binding base of the snowboard binding.
Figure 8:
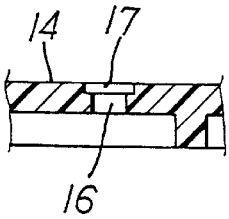
FIG. 8 is a partial cross sectional view taken along lines 8—8 of FIG. 6.
Figure 6:
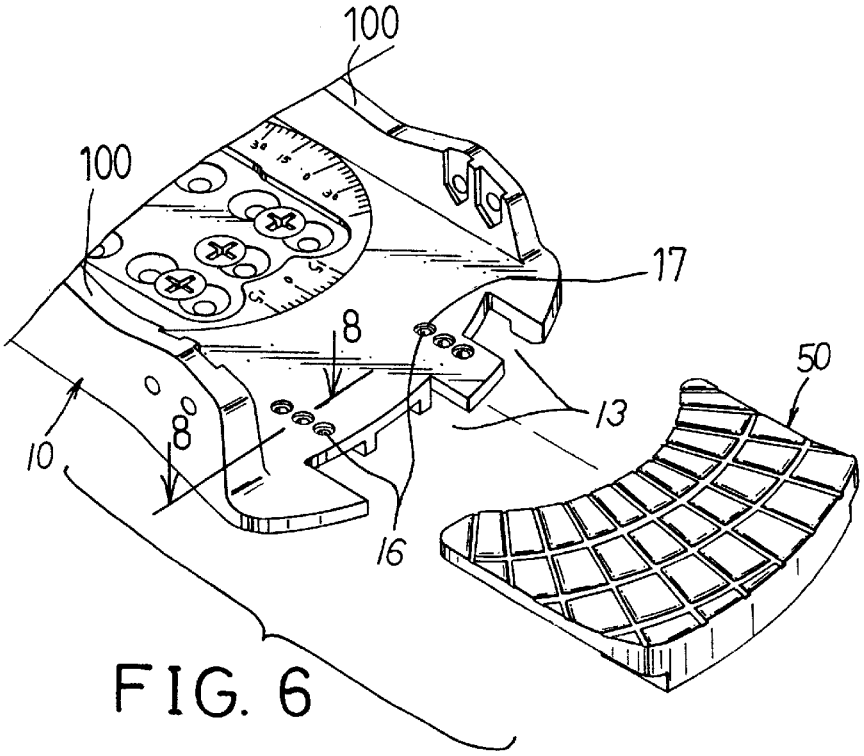
FIG. 6 is a partial exploded view similar to FIG. 2, illustrating the other application for attaching the toe member to the binding base of the snowboard binding.
Figure 9:
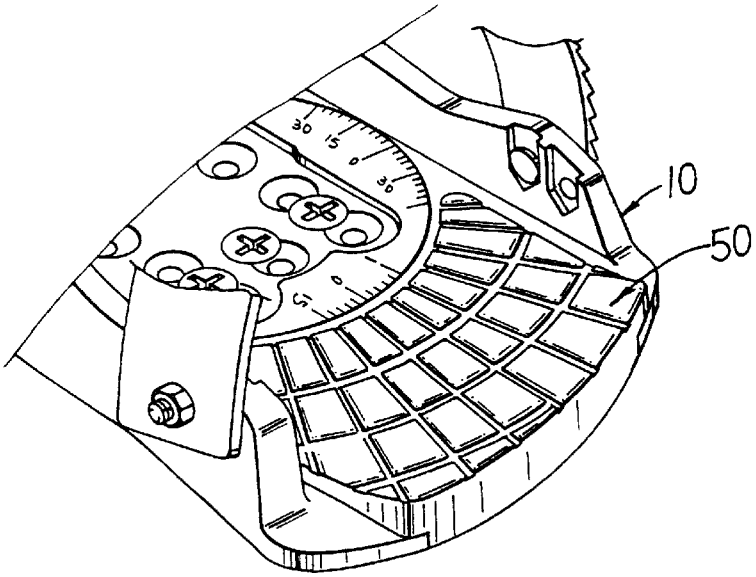
FIG. 9 is a partial upper perspective view showing the attachment of the toe member as shown in FIG. 6 to the front portion of the binding base of the snowboard binding.
Figure 10:
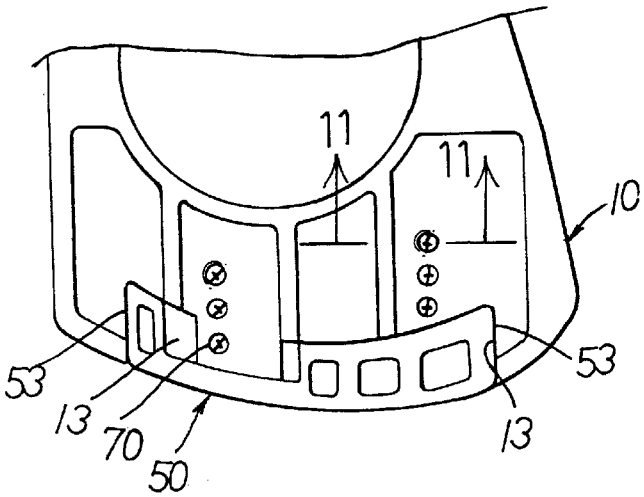
FIG. 10 is a partial bottom plane view illustrating the adjustment of the toe member relative to the binding base of the snowboard binding as shown in FIG. 9.
Figure 11:
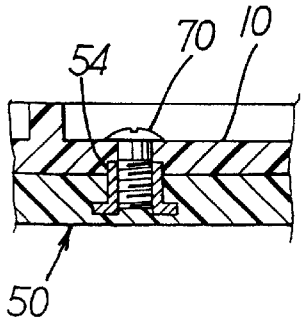
FIG. 11 is a partial cross sectional view taken along lines 11—11 of FIG. 10.

Referring next to FIGS. 2–4, the binding base 10 includes a pair of walls 100 extended upward from the side portions respectively, and includes one or more channels 13 of various sizes formed in the front portion thereof. The walls 100 each includes a recess 11 formed in the front and inner portion thereof for defining a shoulder 110 therein, and each includes one or more orifices 12 formed therein and communicating with the recess 11 of the wall 100. The toe member 50 includes one or more ribs 53 of various sizes formed in the bottom and front portion thereof (FIG. 3) for slidably engaging with the respective channels 13 of the binding base 10 and for guiding the toe member 50 to move forward and rearward relative to the binding base 10 (FIG. 5). The toe member 50 further includes a pair of panels 51 extended upward from the side portions thereof for slidably engaging with the respective recesses 11 of the walls 100 of the binding base 10 and for further guiding the toe member 50 to move forward and rearward relative to the binding base 10 (FIG. 5). The engagement of the panels 51 with the shoulders 110 of the walls 100 may limit the relative movement between the toe member 50 and the binding base 10. The panels 51 each includes a slot 52 formed therein. A pair of fasteners 70 are engaged through either of the orifices 12 of the respective walls 100 and are slidably engaged through the slots 52 of the panels 51 and are threaded with the nuts 71 for adjustably securing the toe member 50 to the binding base 10. The fasteners 70 may also be engaged through the ends of the toe strap 20 for securing the toe strap 20 to the binding base 10.

Referring next to FIGS. 6–11, the toe member 50 may include one or more fasteners, such as the nuts 54, secured therein. The binding base 10 may include one or more, particularly one or more pairs of step holes 16, 17 formed therein (FIGS. 6, 8) for receiving the fasteners 70 and for receiving a portion of the nuts 54 (FIG. 11), such that the toe member 50 may also be adjustably secured to the front portion of the binding base 10 for adjusting the snowboard binding to different lengths and for attaching the boots of various sizes to the snowboard with the adjustable snowboard binding.

It is to be noted that the heel member 60 of the snowboard binding may also be adjustably secured to the binding base 10 by a similar adjusting mechanism. However, the attachment of the heel member 60 to the binding base 10 is not related to the present invention and will not be described in further details.

Accordingly, the snowboard binding in accordance with the present invention includes an adjustable toe member for adjusting the snowboard binding to different lengths and for attaching the boots of various sizes to the snowboard with the adjustable snowboard binding.

Although this invention has been described with a certain degree of particularity, it is to be understood that the present disclosure has been made by way of example only and that numerous changes in the detailed construct ion and the combination and arrangement of parts may be resorted to without departing from the spirit and scope of the invention as hereinafter claimed.

I claim:

1. A snowboard binding comprising:

a binding base including a front portion having at least one channel formed therein and having at least one hole formed therein, and including two side walls extended upward therefrom, said walls each including a front portion having a recess formed therein for defining a shoulder therein, a toe strap and an instep strap and a heel member attached to said binding base, a toe member including a bottom portion having at least one rib extended therefrom and slidably engaging with said at least one channel of said binding base for guiding said toe member to move and to adjust relative to said binding base, said bottom portion of said toe member including at least one nut provided therein, said toe member including two side panels extended therefrom and slidably engaged with said front portions of said walls respectively, said panels of said toe member being engageable with said shoulders of said walls for limiting a relative movement between said toe member and said binding base, at least one fastener engaged through said at least one hole of said binding base and engaged with said at least one nut of said toe member for securing said toe member to said binding base, and means for adjustably securing said panels of said toe member to said walls.

* * * * *